US006056538A

United States Patent [19]

Büchner et al.

[11] Patent Number: 6,056,538

[45] Date of Patent: May 2, 2000

[54] APPARATUS FOR SUPPRESSING FLAME/ PRESSURE PULSATIONS IN A FURNACE, PARTICULARLY A GAS TURBINE COMBUSTION CHAMBER

[75] Inventors: Horst Büchner, 3, rue du Margrave de Bade, F-67500 Marienthal, France; Wolfgang Leuckel, Auf der Judenhut 1, D-67098 Bad Dürkheim, Germany

[73] Assignees: DVGW Deutscher Verein des Gas-und Wasserfaches-Technisch-Wissenschaftliche Vereinigung, Bonn, Germany; Horst Büchner, Marienthal, France; Wolfgang Leuckel, Bad Durkheim, Germany

[21] Appl. No.: 09/235,475

[22] Filed: Jan. 22, 1999

[30] Foreign Application Priority Data

Jan. 23, 1998 [EP] European Pat. Off. ..... 98 101 150

[51] Int. Cl.[7] ..... F23C 9/00

[52] U.S. Cl. ..... 431/115; 431/160; 431/350; 431/349; 431/177; 431/171; 60/39.11; 60/39.83; 60/750; 60/746

[58] Field of Search ..... 431/115, 116, 431/9, 8, 160, 159, 349, 350, 353, 1, 187, 171, 177; 60/39.11, 39.83, 746, 750, 747, 749; 110/204, 205; 126/79

[56] References Cited

U.S. PATENT DOCUMENTS

| | | | |
|---|---|---|---|
| 2,869,629 | 1/1959 | Nerad | 431/115 |
| 3,000,182 | 9/1961 | Buswell | 60/747 |
| 3,213,919 | 10/1965 | Calzolari | 431/9 |
| 4,357,134 | 11/1982 | Katsushige et al. | 431/115 |
| 4,488,869 | 12/1984 | Voorheis | 431/351 |
| 5,044,932 | 9/1991 | Martin et al. | 431/115 |
| 5,149,261 | 9/1992 | Suwa et al. | 431/350 |
| 5,263,849 | 11/1993 | Irwin et al. | 431/1 |
| 5,411,394 | 5/1995 | Beer et al. | 431/115 |
| 5,688,115 | 11/1997 | Johnson | 431/115 |
| 5,692,890 | 12/1997 | Graville | 431/9 |

FOREIGN PATENT DOCUMENTS 0 754 908 1/1997 European Pat. Off. .

*Primary Examiner*—Ira S. Lazarus
*Assistant Examiner*—Josiah C. Cocks
*Attorney, Agent, or Firm*—Akin, Gump, Strauss, Hauer & Feld, L.L.P.

[57] ABSTRACT

An apparatus is provided for suppressing flame/pressure pulsations in a furnace, in which a flame is surrounded by a gas shroud stream having a higher flow speed, whereby a ring vortex formation is stopped. In order for this gas shroud stream to be able to achieve smaller gas volumes, a screen is provided that surrounds the gas outlet openings and runs at a spacing around the burner, so that a flue gas recirculation area associated with the combustion chamber is separated from the outlet location of the gas shroud stream and thus the gas shroud stream itself.

11 Claims, 5 Drawing Sheets

APPARATUS FOR SUPPRESSING FLAME/PRESSURE PULSATIONS IN A FURNACE, PARTICULARLY A GAS TURBINE COMBUSTION CHAMBER

BACKGROUND OF THE INVENTION

The invention involves an apparatus for suppressing flame/pressure pulsations in a furnace having at least one burner for generating a flame and a combustion chamber into which the flame is directed, wherein the furnace has at least one gas outlet opening, from which flows gas that surrounds the flame in the form of a shroud or jacket and has a higher flow speed in the flame propagation direction than the outer regions of the flame. The invention is also related to a combustion chamber of a gas turbine that incorporates such an apparatus.

In industrial combustion systems such as gas turbines, combustion chambers, blast heaters, residue combustion systems or industrial ovens, but also for small furnaces such as gas boilers or heating furnaces in domestic use, unstable operating conditions occur under certain circumstances that are determined by the parameters of furnace operation, such as thermal output and air ratio, which are characterized by time-periodic changes of the flame that are accompanied by changes, in particular of the static pressure in the combustion chamber, as well as in pre-connected or post-connected system parts. These unstable conditions also occur in furnaces whose flames are sufficiently ignition-stabilized by known measures such as swirling flows, baffle structures, etc.

The occurrence of these combustion instabilities often causes a changed behavior compared to the steady-state operation of the system and also causes, besides an increased noise level, an increased mechanical and/or thermal stress of the combustion chamber and/or the combustion chamber lining. Such flame/pressure pulsations can, at unfavorable ratios, lead to damage of the system in which they occur, so that much expense is incurred in order to prevent such flame/pressure pulsations. Thus, for example, the combustion chamber geometry is changed by specially installed components, which, however, frequently leads only to a shift in the pulsation frequencies that occur, and thus does not contribute to a general solution of the problem. Otherwise, special measures are taken each time on an empirical basis for any occurring flame/pressure pulsations.

In European published patent application EP-A-0 754 908 (U.S. application Ser. No. 08/797,381), a device is proposed for this purpose, as mentioned above, in which the flame of a burner is surrounded as closely as possible by a flow of gas, such that the gas flow has a higher speed in the flame propagation direction than the outer and/or edge areas of the flame and/or of the fuel-containing burner main stream.

As used herein, insofar as mention is made of the "outer areas of the flame," this is understood to mean the reacting or reactable layers of a fuel and/or combustible gas/air flow. Upon these layers the gas shroud stream effects a transfer of the axial momentum.

As used herein, "flame propagation direction" shall mean the main propagation direction in the axial extension of a flame, and this is to be distinguished from the radial propagation direction of the flame.

The principle of the invention is thus based on the discovery that the pulsations are essentially caused or increased by ring vortices periodically forming in the edge area of the flame. These ring vortices, which arise from the rolling up of the edge areas of the fuel-containing burner stream, incorporate during their formation hot, already burned and no longer reactable flue gases that cause a quick heating up of the fuel/air mixture already contained in the ring vortex, and as a result cause a periodic pulse-type reaction of the fuel inside the ring vortex structures that excites pressure pulsations.

In order to now prevent this ring vortex formation, the flame, as described above, is surrounded by a gas shroud stream that exits at as small a radial distance as possible from the flame or from the burner main stream and that has a higher flow speed in the flame propagation direction than the outer or edge areas of the flame. Thus, an axial momentum exchange occurs between the shroud stream and the flame or the fuel gas/air stream which causes an acceleration of the free flame boundary layer or stream boundary layer of the fuel/air mixture, such that the periodic formation of reactable vortices in this area is effectively opposed.

To the extent that corresponding ring vortices then occur again at the boundary layer between the gas shroud stream and the surrounding medium (in the included case, generally flue gases), it is most favorable if the gas shroud stream does not contain any fuel, since then no fuel-containing vortex could then form from the (fuel-free) shroud stream, which could lead to a periodic pulse-type reaction of the fuel and thus to an excitation of flame/pressure pulsations as they occur for a non-shrouded flame or fuel/air stream.

In a more preferred manner, with the non-fuel containing gas of the shroud stream, this involves air, which is available everywhere in sufficient quantity. It is, however, also conceivable to use an inert gas here which, of course, would have a certain cost disadvantage as a result.

BRIEF SUMMARY OF THE INVENTION

Especially for the case of inert gas, the object arises of further developing an apparatus as described above in such a manner that a smaller gas stream or a smaller gas quantity per time unit is necessary in order to obtain the desired effect. However, even with the use of air, there is an interest in having to provide little air for the shroud stream, in order not to have to make available or otherwise divert too much compressor output for this usage purpose.

This object is accomplished according to the invention in that a screen is provided surrounding the gas outlet opening and running at a radial distance around the burner outlet, through which a flue gas recirculation area connected to the combustion chamber is separated from the aforementioned gas.

It has been determined that, because of the spatial separation of the fuel/air mixture and the gases surrounding it in the form of a shroud from the outer recirculation flow of hot, burned-out flue gases, the shroud stream is better protected by means of the screen from a lateral deflection, and therefore less greatly deflected in regard to its direction. Smaller momentum flow densities or gas speeds of the shroud stream are thereby also sufficient to ensure that the shroud stream reaches, with sufficient axial momentum, i.e. with a sufficient excess speed in relation to the edge areas of the flame, those positions situated downstream from the burner outlet, at which the aforementioned periodic formation of reactable, i.e. fuel-containing, ring vortices should be avoided.

By the use of the screen, a considerable saving of the necessary gas or air quantities or air pulse stream thereby results.

In that the flue gas recirculation area is separated from the outlet location of the gas shroud stream and thus from the gas shroud stream itself, a mixing of hot flue gases from this area of the combustion chamber into the shroud stream is further prevented. Such a mixing otherwise causes a great reduction of the stream speed of the shroud stream, whereby the shroud stream correspondingly heats itself up at the same time.

The design of the gas shroud stream is thus more independent of the remaining construction of the furnace surrounding it. In particular, for several burners possibly mutually influencing each other, this is another advantage of the invention. The screen itself can be constructed herein as one shell, such that it can also be retrofit relatively easily in already existing furnaces.

The radial distance of the screen from the burner outlet is thus to be selected such that the speed of the shroud stream is not too greatly reduced in an undesired way by braking due to a frictional adhesion to the wall. It must be ensured that the shroud stream can reach the locations at which it should prevent the formation of ring vortices.

In particular, it is desired herein, taking into account the gas shroud stream expanding away from its outlet, that the upper (forward or downstream) edge of the screen have a radial spacing from the gas outlet opening and that the gas shroud stream impinges only just before this upper edge on the inner side of the screen. An undesired in-flow of hot flue gases along the inner side of the screen, which would then be mixed into the gas shroud stream at its outlet location, can thereby also be prevented.

This goal can thus be achieved in that the screen is constructed in a cylindrical manner and is arranged concentrically to the burner outlet. It is, however, also possible to give the screen itself a conical shape having a slope which is then fitted to the expansion angle of the shroud stream. In both cases the screen extends herein essentially parallel to the flame propagation direction, in contrast to which, for example, the extension of the conical screen is considerably smaller in the radial direction.

Fundamentally, the screen can also be constructed having two-shells and can be flowed through by the gas forming the gas shroud stream. The gas shroud can then, for example, completely or at least partially emerge from the screen just at the upper edge of the screen. This makes it possible that the gas can still correspondingly cool the screen, which consists of a high temperature-resistant steel or even of a ceramic material, for example, and thus prevents the occurrence of thermal problems with regard to the screen.

A preferred usage location of the invention is in gas turbines, in particular having several burners, preferably in annular combustion chambers, in which the effect according to the invention, of reducing the mutual influence, becomes very effective.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiment(s) which are presently preferred. It should be understood, however, that the invention is not limited to the precise arrangements and instrumentalities shown. In the drawings.

DETAILED DESCRIPTION OF THE INVENTION

Figure 1:
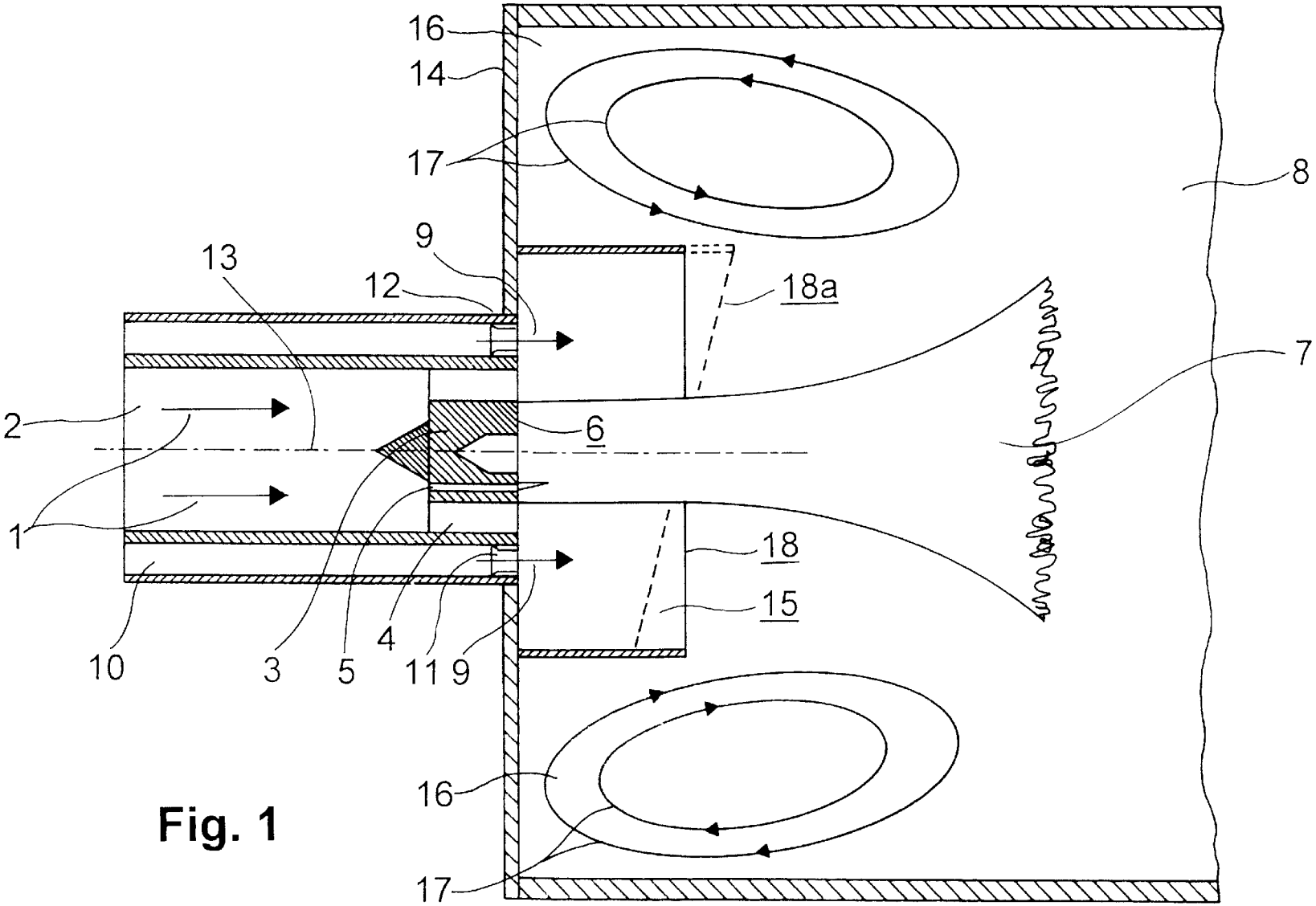
FIG. 1 is a sectional view through a furnace equipped with a cylindrical screen.

In FIG. 1 a furnace equipped according to the invention is depicted in sectional view. It involves a swirl burner, which is supplied with a pre-mixed fuel gas/air mixture 1 via a burner pipe 2. This burner pipe 2 ends at a swirl generator 3 that is rotationally symmetrical and has sloped guide blades 4 on its outer circumference. These guide blades have a slope of approximately 30°, such that the out-flowing fuel gas/air mixture experiences a deflection and thus a swirl. Furthermore, several drill holes 5 passing through the swirl generator 3 are distributed over the circumference radially a bit further inside than the guide blades 4, and through these drill holes 5 a partial stream of the fuel gas/air mixture can flow, and thus contribute by pilot flame formation to stabilizing the flame. On the outer side 6 of the swirl generator 3, the fuel gas/air mixture emerging from the burner is ignited and forms a flame 7 that enters into a combustion chamber 8. This combustion chamber 8 is, in the example depicted here, the annular combustion chamber of a gas turbine, wherein the turbine sections arranged to the right after the combustion chamber in FIG. 1 are not depicted.

The flame 7 is formed by the outer areas of the reacting layers of the fuel gas/air stream, which generate the flame contour, having an intense flame color recognized by an observer. This flame formed by a reacting fuel gas/air mixture is flowed around by a shroud or jacket of gas. This shroud is effected by a gas stream 9, which is conducted through the burner by an annular channel 10 parallel to the burner pipe 2 and emerges from the burner at the gas outlet openings 11. A plurality of these gas outlet openings is distributed around the circumference of the burner. This plurality of openings is arranged closely around the swirl generator 3 of the burner, so that a shroud stream completely surrounding the flame forms from the several resulting gas streams 9 which correspond to the number of gas outlet openings 11.

So that the flow speed of the gas shroud streams emerging from the gas outlet openings 11 is accelerated to the desired value before their emergence from the annular channel 10, quarter-circular nozzles 12 are installed in the gas outlet openings 11, in the embodiment depicted here, which cause a sharp acceleration, in particular of the outer areas of the gas shroud stream in the axial direction (i.e., parallel to the axis 13 of the burner).

The flow speed of the gas shroud stream emerging from the gas outlet openings 11 is accelerated due to the quarter-circular nozzles 12 to such an extent that the speed is considerably higher in the direction of the axis 13 than the speed of the outer areas of the flame 7 of the burning fuel gas/air mixture behind the swirl generator 3. As a result, in the area between the fuel gas/air mixture burning in a flame and the gas shroud stream closely surrounding it, a boundary layer acceleration of the partially burning, partially still not ignited fuel gas/air mixture occurs. This effectively prevents, in the edge area of the flame, the formation of periodic, coherent ring vortice structures that can excite and amplify flame/pressure pulsations by a fast reaction of the fuel contained in them through an in-phase energy supply to the pressure oscillations.

Usually, the gas shroud stream will continuously emerge from the gas outlet openings 11. Since on the other hand, however, the ring vortex structures form periodically, the possibility also exists for operating the air flow in a corresponding periodic manner, i.e. in a discontinuous manner. On the one hand, a certain savings in air mass flow is thereby achieved, while on the other hand, however, a considerably higher regulation expense is necessary. In particular, high costs are associated with the regulation devices to be provided for this, such as valves, controls, etc. Moreover, additional device parts of this type have, as a result, an additional susceptibility to disturb the entire system.

In the furnace depicted, a cylindrical screen 15 is welded on the front side 14 of the combustion chamber 8. This screen has a radial spacing from the burner and also surrounds the gas outlet openings 11. Thus, outside of the screen 15 a flue gas recirculation area 16 is separated from the gas stream 9. This prevents, in this area, flue gases flowing essentially radially inward because of the flow ratios, having a flow path that is indicated by the arrow lines 17, from also being suctioned into the gas stream 9 and thus worsening the effectiveness of the gas stream. Instead, the gas stream can extend in the impinging area as open jets in an uninfluenced manner.

Figure 2:
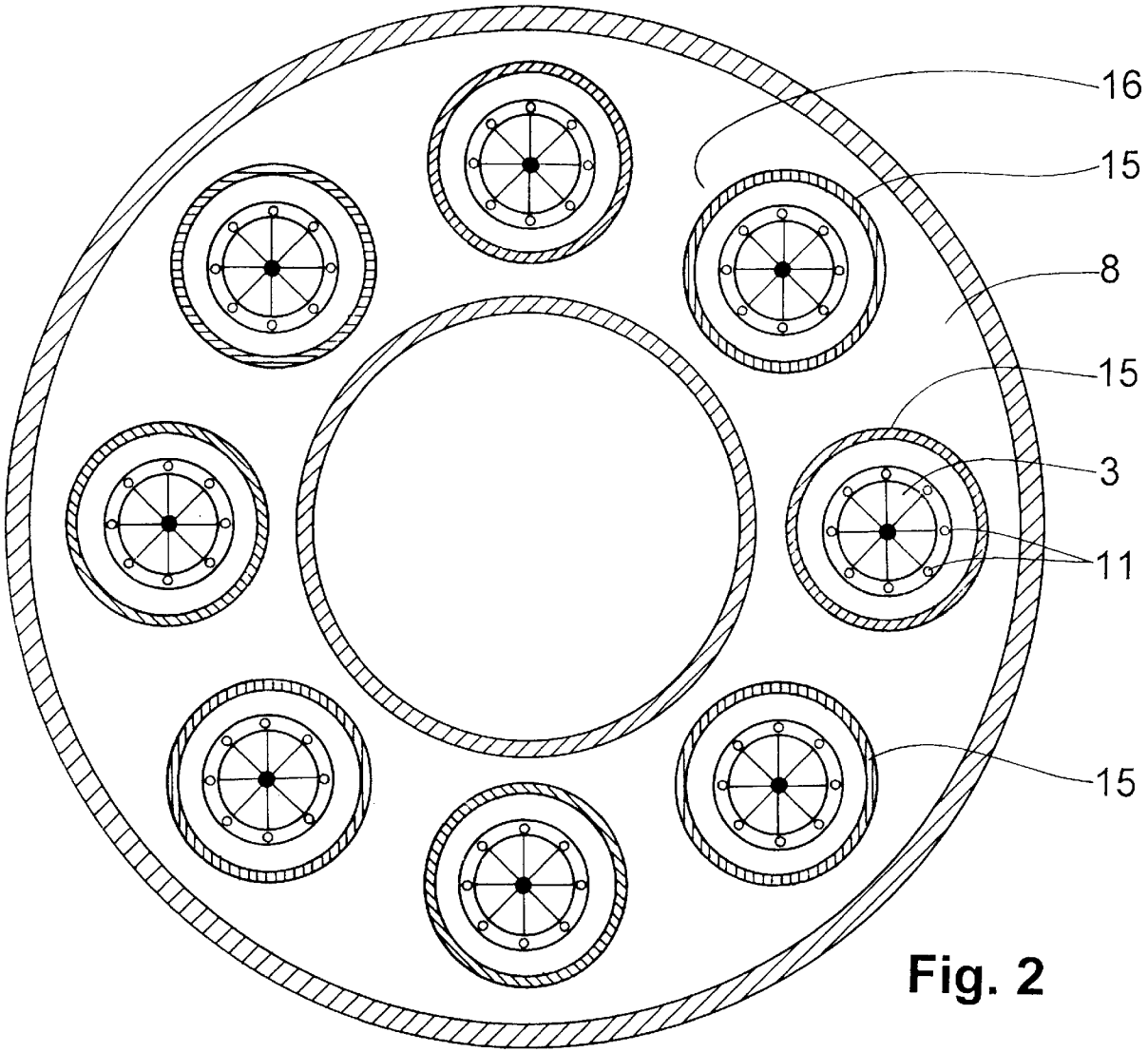
FIG. 2 is a plan view of a furnace according to FIG. 1 having several burners.

This is especially also advantageous for a furnace having several burners, as is depicted in FIG. 2. FIG. 2 is a sectional view through a ring-shaped combustion chamber 8 of a gas turbine, in which eight burners are distributed around the circumference. In the plan view of these burners, one recognizes respectively the swirl generator 3 and gas outlet openings 11, arranged in a ring-shape, which generate a gas shroud stream on the burner. In order to screen off this gas shroud stream from the influence of adjacent burners or from the flue gas recirculation caused by them, each burner is surrounded by a corresponding screen 15.

With a cylindrical screen, as depicted in FIG. 1, the radial distance between the screen 15 and the gas outlet opening 1I1 is thus selected in such a manner that the gas shroud stream 9, which expands as open jets starting from its emergence from the gas outlet openings 11, first starts in proximity to the upper (i.e., forwardmost or downstream in the flame main propagation direction) edge 18 of the screen 15 on its inner side. Thus, on the one hand, it can be prevented that the gas stream impinges too early on the screen 15 and that the speed of the flow is reduced in an unintended way by braking due to friction with the wall formed by the screen 15. On the other hand, it is thus ensured that between the gas shroud stream and the upper edge 18 of the screen 15, no gap occurs through which flue gases can flow to the outlet areas of the gas shroud stream, such that they would become mixed there in an undesired way.

The distance (spacing) to be selected under these considerations for a known opening angle of the gas shroud stream, which is dependent on the gas density and gas temperature, is to be determined as a function of the extension of the screen parallel to the flame main propagation direction through simple trigonometric relationships.

Fundamentally, it is not necessary that the upper edge 18 of the screen 15 run perpendicular to the axis 13 as represented by the continuous line 18 in FIG. 1. Instead, the screen 15 can have a varying length over its circumference, so that its upper edge runs obliquely to the axis 13 of the burner, as represented by the dashed line 18*a*, for example. It should also be mentioned in this regard, that with such a configuration of the screen 15 with varying length over its circumference, the screen 15 can be arranged eccentrically in reference to the flame main propagation direction and/or the gas shroud stream, which is optionally likewise eccentric.

Besides a straight line upper edge 18 or an obliquely running upper edge 18*a*, as described here and represented in FIG. 1, it would also be conceivable for the upper edge of the screen 15 to have a wavy shape, for example, around its circumference. For sake of good order, it should also be mentioned that, in the example described here, the flame main propagation direction coincides with the axis of the burner 13.

Figure 3:
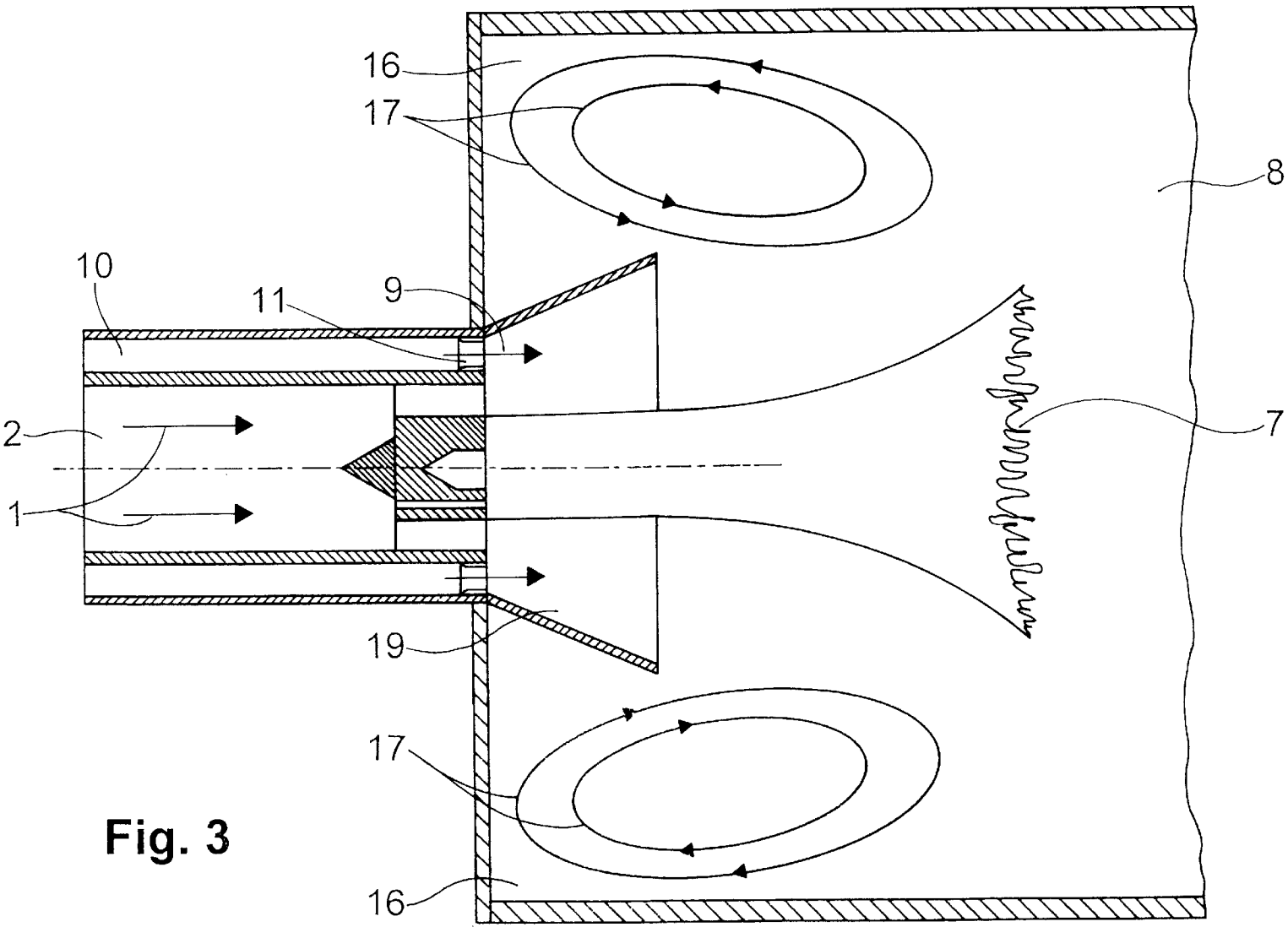
FIG. 3 is a sectional view through a furnace equipped with a conical screen.

Instead of a cylindrical screen as depicted in FIG. 1, a conical screen 19 (see FIG. 3) can also be used, whose opening angle should then correspond approximately to the opening angle of the gas shroud stream 9 emerging from the gas outlet openings 11.

Figure 4:
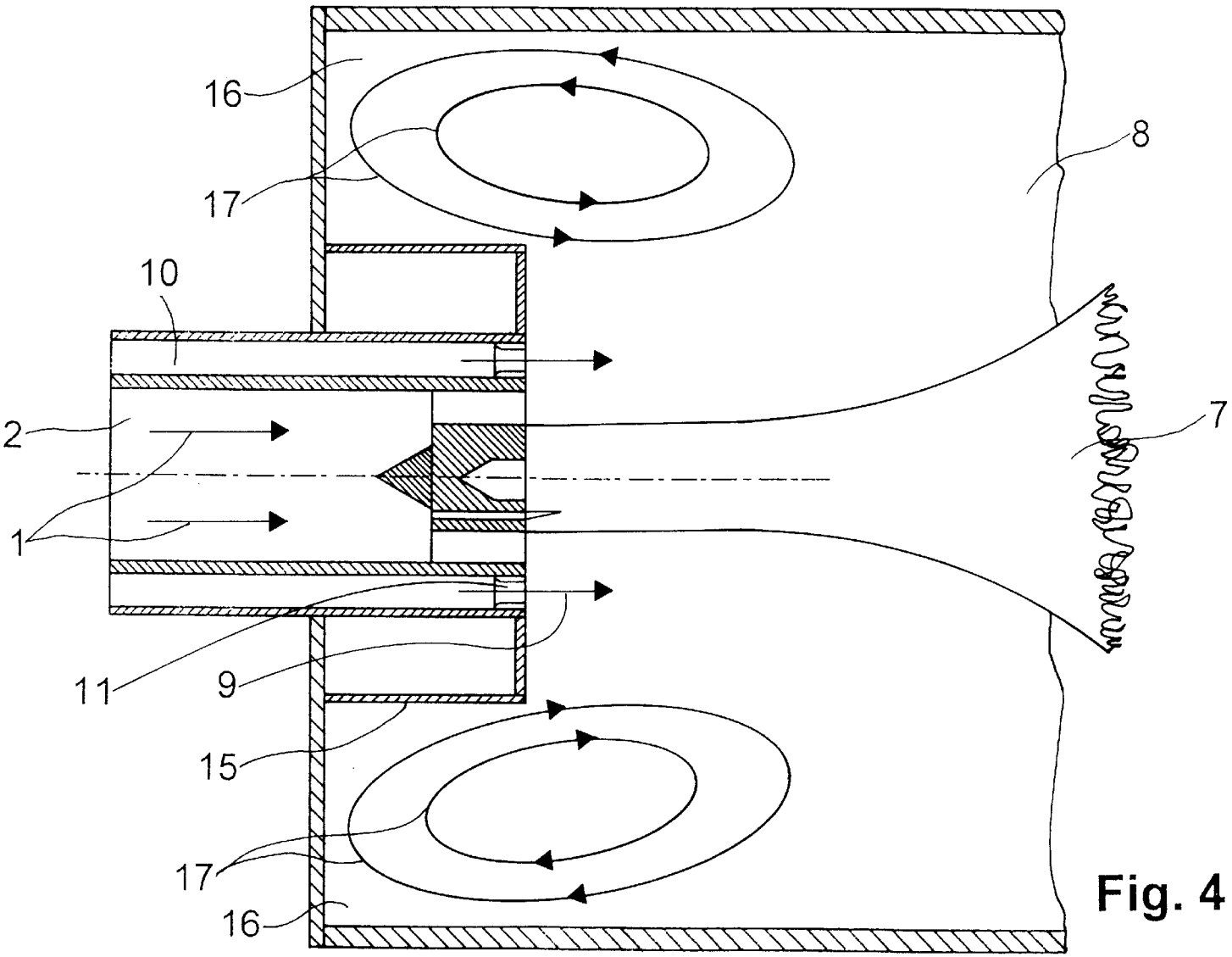
FIG. 4 is a sectional view through a furnace having a screen that surrounds a forwardly displaced burner outlet.

In FIG. 4, furthermore, another embodiment is depicted, in which the burner is forwardly displaced within the cylindrical screen in the flame propagation direction. The effect obtained here is essentially to be attributed to the fact that the recirculation of the flue gas occurs with a flow component directed radially toward the burner in the flue gas recirculation area 16. Therefore, in the plane in which the gas outlet openings 11 lie in the example depicted in FIG. 4, the flue gas recirculation does not exhibit any additional, noticeable radial flow components, but is instead distinguished essentially by its axial flow.

Figure 5:
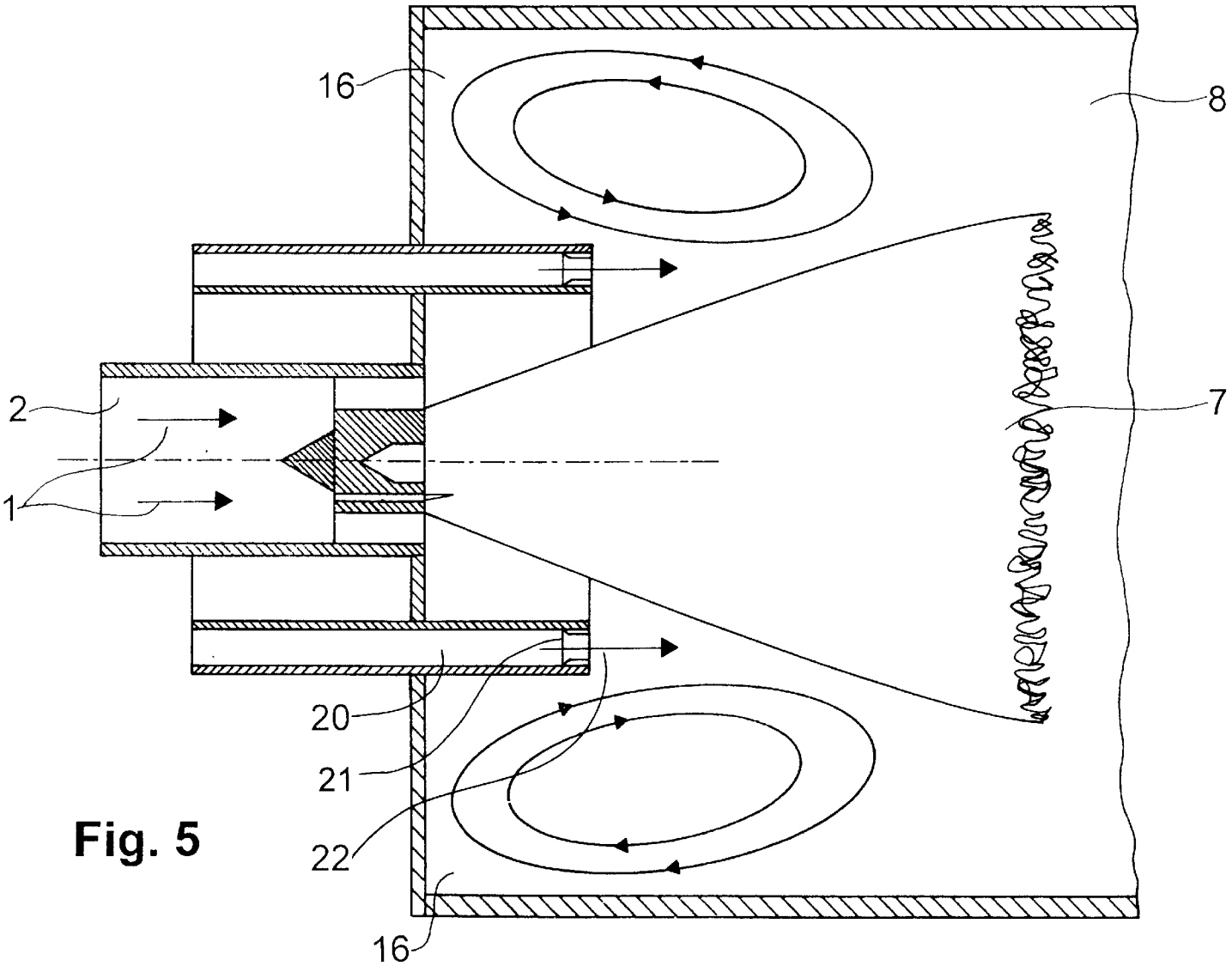
FIG. 5 is a sectional view through a furnace having a supply for the gas shroud stream integrated into the screen.

In FIG. 5, an additional alternative is depicted: here a double-walled screen 20 is provided, which is flowed through by the gas for the gas shroud stream and has corresponding gas outlet openings 21 provided on the upper edge, from which the gas shroud stream 22 emerges.

Here as well, in the area in which the gas shroud stream 22 emerges from the gas outlet openings 21, the recirculation of the flue gases without significant radial flow components and the gas shroud stream 22 can prevent the ring vortices without being hindered here by flue gases flowing in radially. It is supposed herein that the areas, at which periodic ring vortices form at the outer areas of the flame as described above, lie downstream from the gas outlet openings 21.

In the example depicted in FIG. 5, the gas flowing through the double-walled screen has an additional cooling function for the screen.

Moreover, the screens are each made of high temperature-resistant steel or even of an appropriate ceramic material.

In summary, it can thus be realized that by the use of a screen according to the invention, an influence of the gas shroud stream by a flue gas circulation can be limited, and thus also with smaller gas quantity streams or gas pulse streams, a sufficient prevention of ring vortex structures can be obtained. Especially for gas turbines, but also with annular combustion chambers, a problem-free operation can thus be achieved with the invention.

It will be appreciated by those skilled in the art that changes could be made to the embodiment(s) described above without departing from the broad inventive concept thereof. It is understood, therefore, that this invention is not limited to the particular embodiment(s) disclosed, but it is intended to cover modifications within the spirit and scope of the present invention as defined by the appended claims.

We claim:

1. Apparatus for suppressing flame/pressure pulsations in a furnace comprising at least one burner for generating a flame (7) and a combustion chamber (8) into which the flame (7) is directed, the furnace having at least one gas outlet opening (11, 21) from which flows a gas stream (9, 22) that surrounds the flame (7) in a form of a shroud, the gas stream (9, 22) having a higher flow speed in a flame main propagation direction (13) than outer areas of the flame, and further comprising a screen (15, 19, 20) surrounding the at least one gas outlet opening (11, 21) and running at a radial spacing around a burner outlet, such that a flue gas recirculation area (16) associated with the combustion chamber (8) is separated from the gas stream (9, 22).

2. Apparatus according to claim 1, wherein the screen (15, 19) comprises a single shell.

3. Apparatus according to claim 1, wherein the screen (20) comprises a double shell and is flowed through by the gas stream (22).

4. Apparatus according to claim 1, wherein the screen (15, 19, 20) extends essentially parallel to the flame main propagation direction (13).

5. Apparatus according to claim 1, wherein the screen (15, 20) is cylindrical and concentric with the burner.

6. Apparatus according to claim 1, wherein the screen (19) has a conical shape.

7. Apparatus according to claim 1, wherein an upper edge (18) of the screen (15) has a radial spacing from the gas outlet opening (11) and the gas stream (9) first impinges on an end of the screen on its inner side.

8. Apparatus according to claim 1, wherein the screen comprises of high temperature-resistant steel.

9. Apparatus according to claim 1, wherein the screen comprises of a ceramic material.

10. A gas turbine comprising an apparatus for suppressing flame/pressure pulsations according to claim 1, wherein the furnace of the turbine has a plurality of burners.

11. The gas turbine according to claim 10, wherein the combustion chamber (8) into which the flame (7) is directed is an annular combustion chamber.

* * * * *